US006775885B1

(12) United States Patent
Wang

(10) Patent No.: US 6,775,885 B1
(45) Date of Patent: Aug. 17, 2004

(54) TWO WAY OPEN-END ZIPPER

(76) Inventor: Lien-Chou Wang, No. 273, San Jiunn Street, Shu Lin Chen, Taipei Hsien (TW)

( * ) Notice: Subject to any disclaimer, the term of this patent is extended or adjusted under 35 U.S.C. 154(b) by 0 days.

(21) Appl. No.: 10/437,184

(22) Filed: May 14, 2003

(51) Int. Cl.[7] ..... A44B 19/00

(52) U.S. Cl. ..... 24/385; 24/386; 24/387; 24/390; 24/415; 24/433; 292/307; 292/327; 70/68; 70/72

(58) Field of Search ..... 24/385, 386, 387, 24/390, 433, 432, 415; 292/307, 327; 70/68, 72, 74

(56) References Cited

U.S. PATENT DOCUMENTS 2,553,230 A * 5/1951 Bashover ..... 24/386
3,605,208 A * 9/1971 Carlile ..... 24/390
3,663,996 A * 5/1972 Heimberger et al. ..... 24/433
3,872,551 A * 3/1975 Moertel ..... 24/386
3,900,926 A * 8/1975 Takahashi et al. ..... 24/386
4,099,301 A * 7/1978 Fujisaki ..... 24/386
6,112,376 A * 9/2000 Akashi et al. ..... 24/433
6,481,068 B1 * 11/2002 Takasawa ..... 24/433

* cited by examiner

*Primary Examiner*—Victor Sakran
(74) *Attorney, Agent, or Firm*—Troxell Law Office PLLC

(57) ABSTRACT

A two way open-end zipper formed of two zipper tapes, left and right top stops, a plug pin and a fixed pin and two slides is disclosed in which the fixed pin has a first upright sidewall, a second upright sidewall, a longitudinal sliding way defined between the first and second upright sidewalls for the passing of the slides during installation of the slides, and a springy hook projected from the first upright side wall into the longitudinal sliding way and adapted to stop the slides in place when the slides moved downwards along the zipper tapes to the lower limit position.

16 Claims, 16 Drawing Sheets

TWO WAY OPEN-END ZIPPER

BACKGROUND AND SUMMARY OF THE INVENTION

The present invention relates to zippers and, more particularly, to a two way open-end zipper, which is easy and inexpensive to manufacture and, enables the user to replace the slides when the slides damaged.

FIGS. 1 and 2 illustrate a two way open-end zipper 8 according to the prior art. This structure of two way open-end zipper 8 is still not satisfactory in function. Because the left and right top stops 81, the left bottom pin (the plug pin) 83 and the right bottom pin (the fixed pin) 84 are stamped from metal containing lead and nickel, the zipper 8 does not meet environment protection requirements. When pulling the lower slide 91 downwards with much force, the lower slide 91 may be moved over the plug pin 83 and disconnected from the zipper 8. When the lower slide 91 moved to the lower limit position, the bottom side of the lower slide 91 downwardly protrudes over the bottom end 801 of the zipper tape 80 (see FIG. 2), resulting in a bad looking. Further, it is inconvenient to stitch the zipper 8 to the clothes.

There are known two way open-end zippers in which the top stops and the bottom pins are directly injection-molded from plastics on the zipper tapes. However, because the top stops and the bottom pins must be separately injection-molded on the zipper tapes, the fabrication procedure of these zippers is complicated, resulting in a high manufacturing cost.

Therefore, it is desirable to provide a two way open-end zipper that eliminates the aforesaid drawbacks.

The present invention has been accomplished to provide a two way open-end zipper, which eliminates the aforesaid drawbacks. According to one aspect of the present invention, the top stops and the plug and fixed pins are injection-molded from plastics on the zipper tapes at a time, therefore the fabrication of the two way open-end zipper is simple and economic. According to another aspect of the present invention, the slides are detachably coupled to the zipper tapes. When the slides damaged, they can be removed from said zipper tapes for a replacement. According to still another aspect of the present invention, when the lower slide moved to the lower limit position, the bottom side of said lower slide is maintained in front of the bottom side of the corresponding zipper tape. According to still another aspect of the present invention, the fixed pin has a first upright sidewall, a second upright sidewall, a longitudinal sliding way defined between the first and second upright sidewalls for the passing of the slides during installation of the slides, and a springy hook projected from the first upright side wall into the longitudinal sliding way and adapted to stop the slides in place when the slides moved downwards along the zipper tapes to the lower limit position. According to still another aspect of the present invention, the fixed pin has a recessed portion formed in the second upright sidewall and adapted to accommodate the tip of the spring hook. The combined width of the maximum width of the tip of the spring hook plug the width of the second upright sidewall around the recessed portion is slightly smaller than the passageway of each slide for interlocking teeth of the zipper tapes, the slides can easily and smoothly be moved over the fixed pin and coupled to the zipper tapes, which may be made for a small zipper, for example, No. 3 or No. 4.

DETAILED DESCRIPTION OF THE NVENTION

Figure 1:
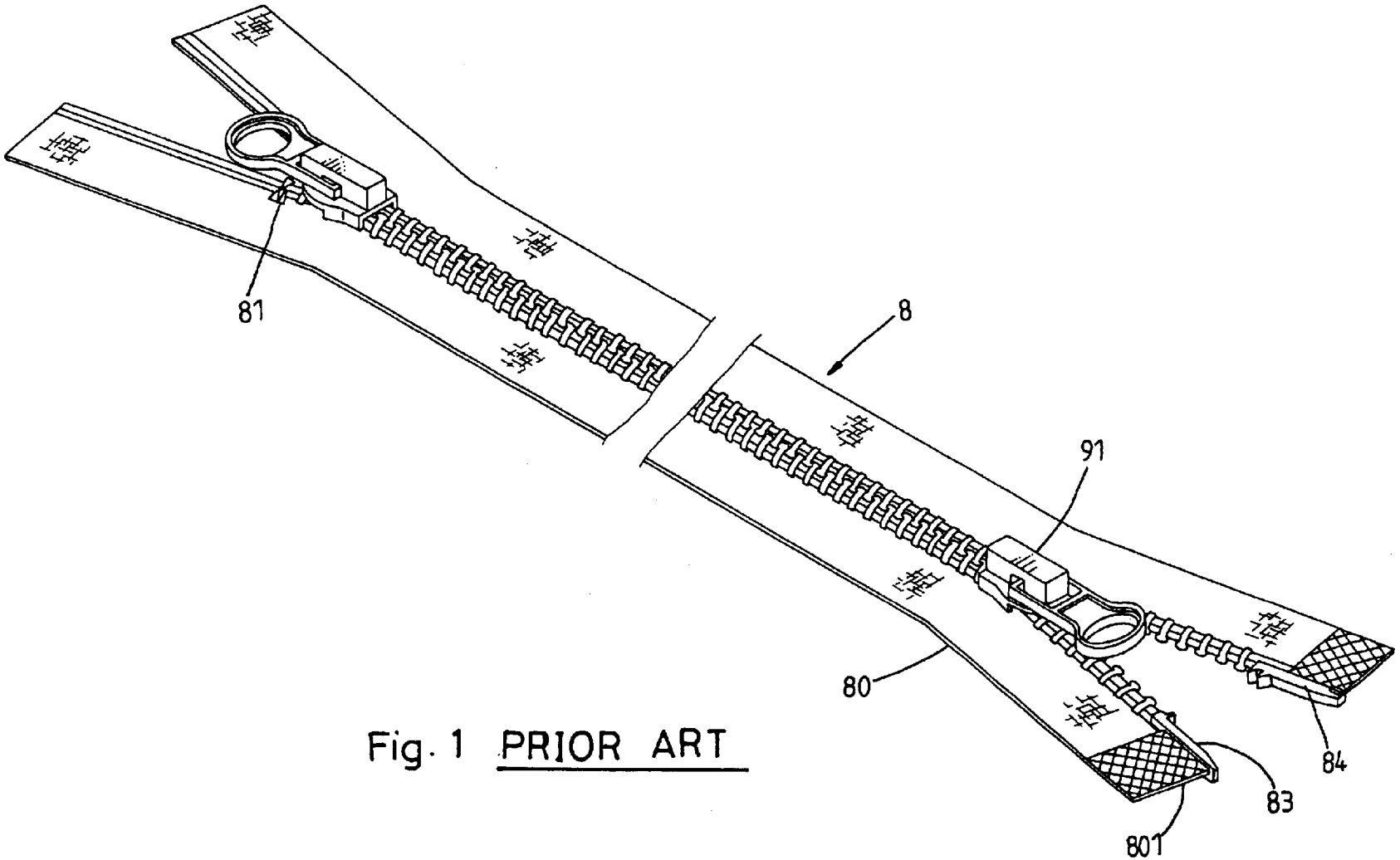
Fig. 1 PRIOR ART
FIG. 1 is a perspective view of a two way opened zipper according to the prior art.
Figure 2:
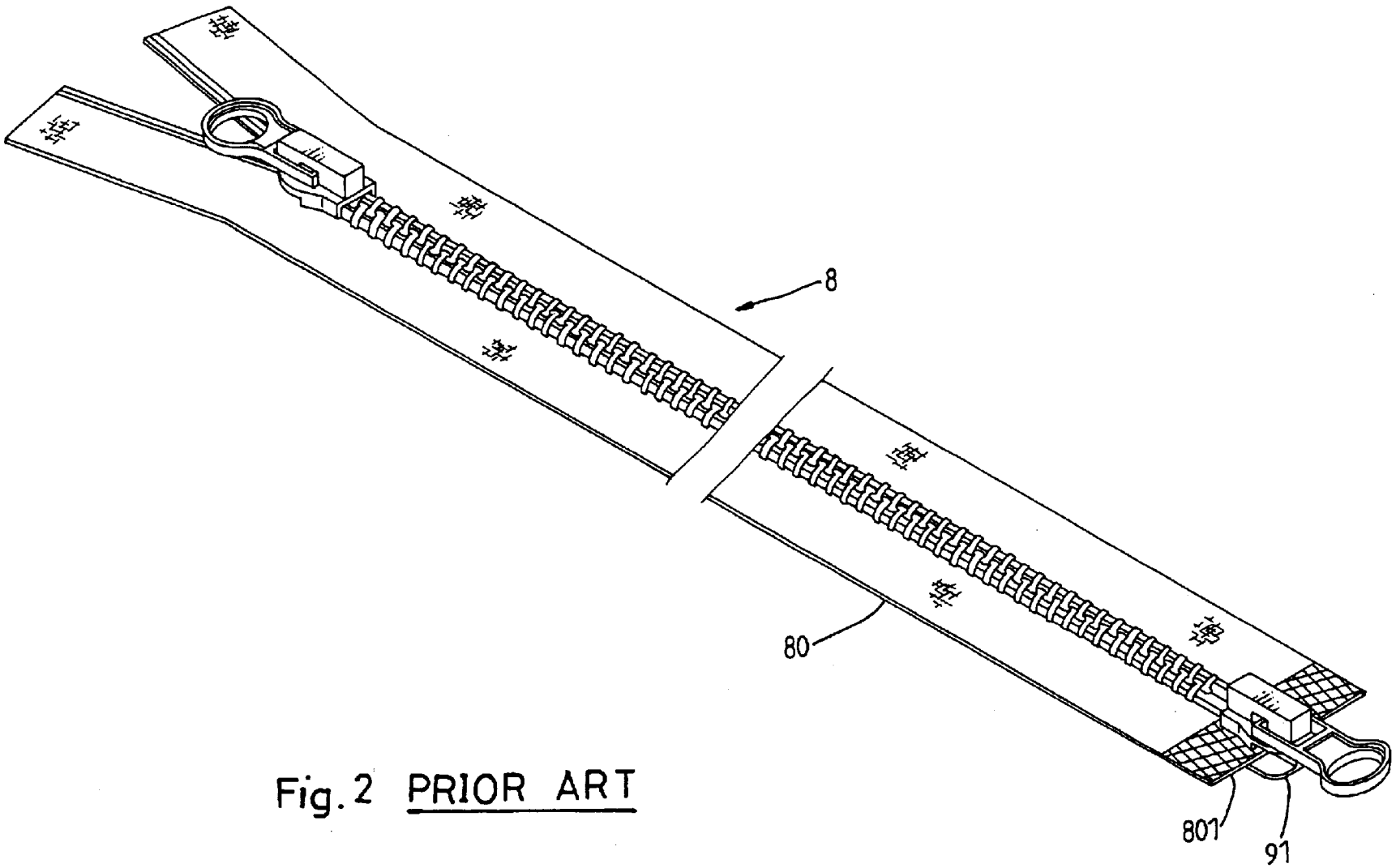
Fig. 2 PRIOR ART
FIG. 2 is similar to FIG. 1 but showing the lower slide moved to the lower limit position and the bottom open-end of the zipper closed.
Figure 3:
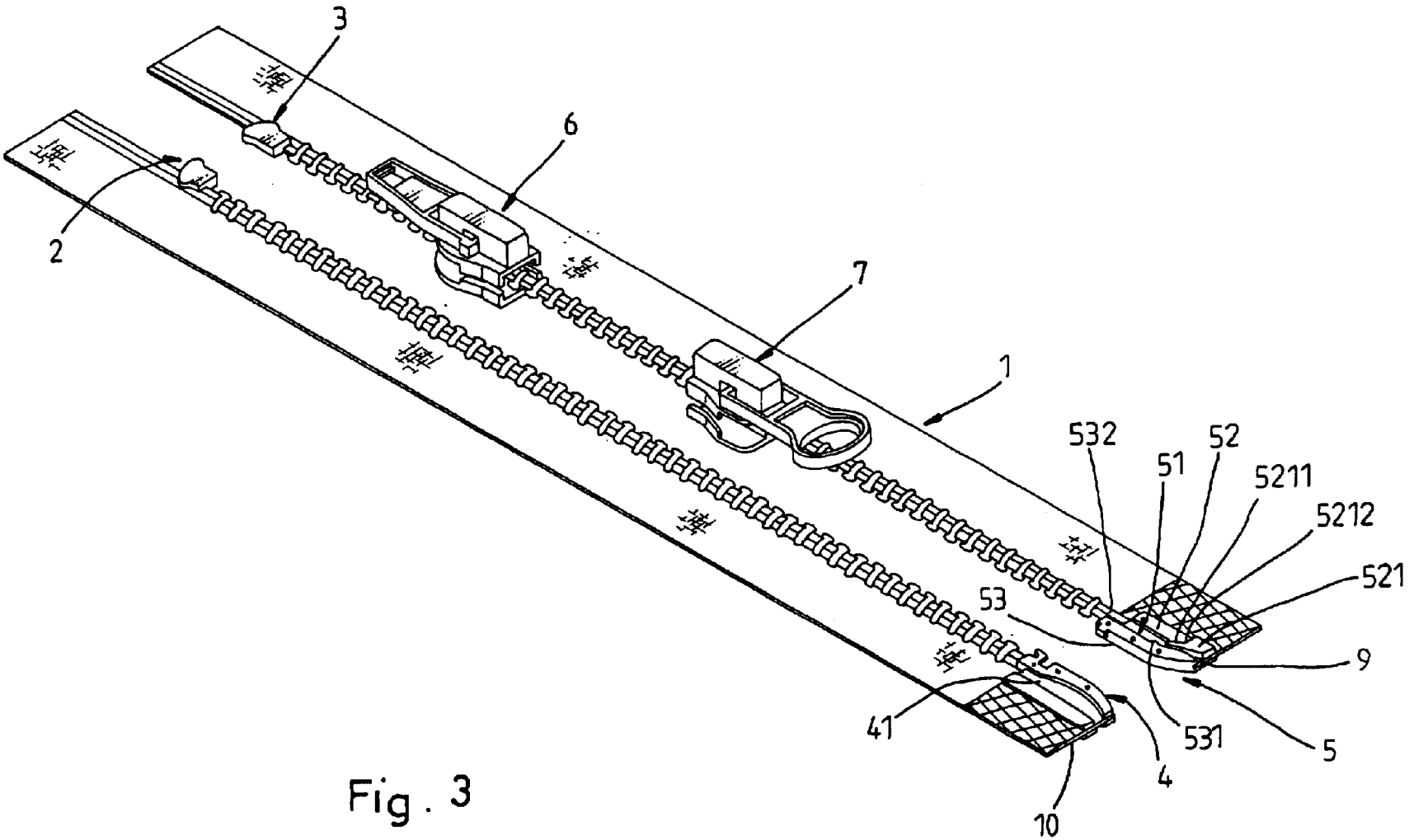
FIG. 3 is an exploded view of a two way open-end zipper according to the first embodiment of the present invention.
Figure 4:
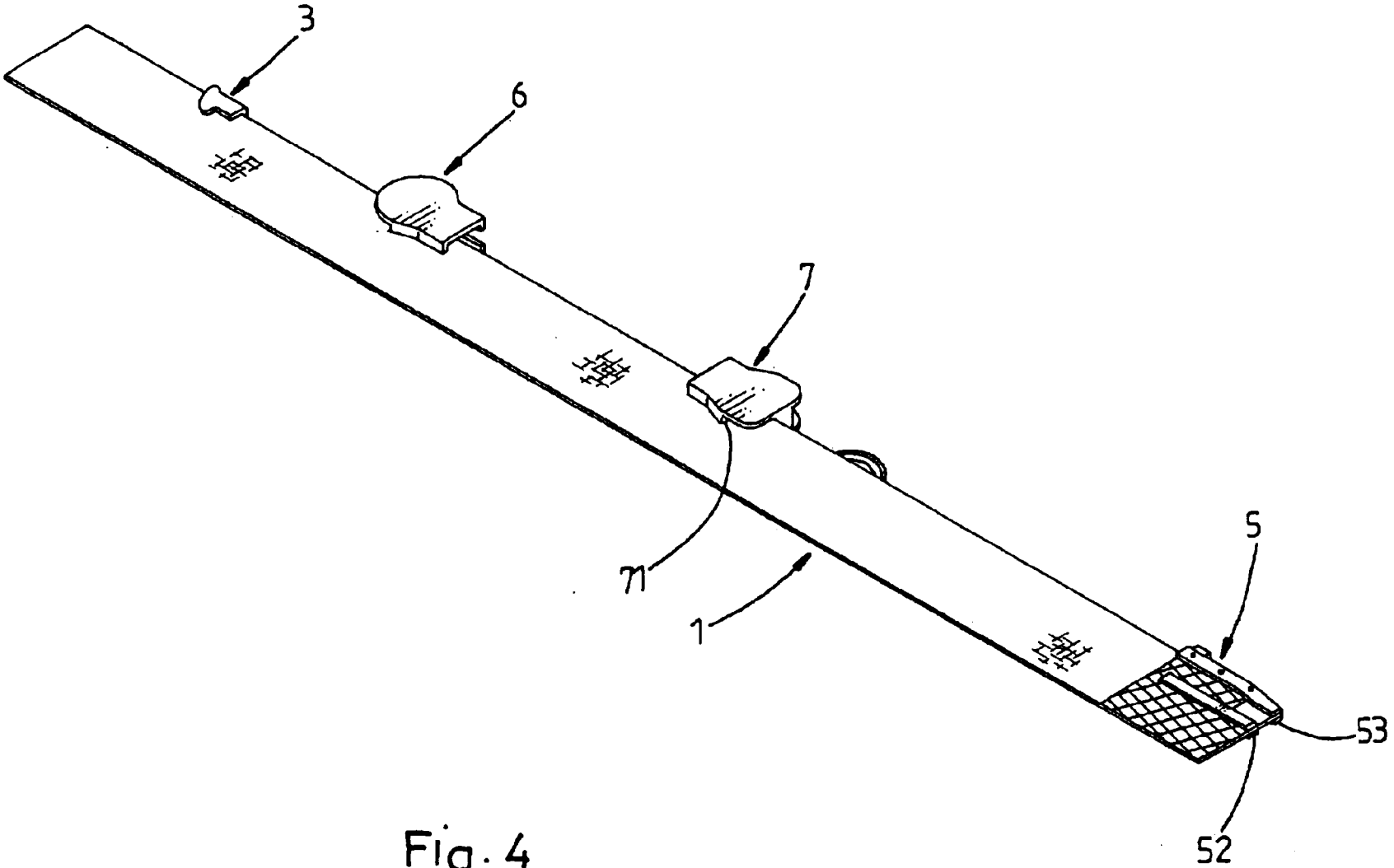
FIG. 4 is a back side view of a part of the two way open-end zipper according to the first embodiment of the present invention, showing the first and second upright sidewalls of the fixed pin fastened to the bottom face of the corresponding zipper tape.

Referring to FIGS. 3~9, a two way open-end zipper in accordance with the first embodiment is shown comprised of two zipper tapes 1, a left top stop 2 and a right top stop 3 respectively fixedly located on the zipper tapes 1 near the top side, a plug pin 4 and a fixed pin 5 respectively fixedly located on the zipper tapes 1 at the bottom side, and two slides, namely, the upper slide 6 and the lower slide 7 respectively coupled to the zipper tapes 1 and adapted to close/open (the interlocking teeth of) the zipper tapes 1. The plug pin 4 and the fixed pin 5 each have a longitudinally extended sliding way 41 or 51.

The main features of the aforesaid first embodiment of the present invention are outlined hereinafter. The fixed pin 5 has a first upright sidewall 52 longitudinally extended along one side of the sliding way 51, a second upright sidewall 53 longitudinally extended along the other side of the sliding way 51 and facing the plug pin 4, and a springy hook 521 projected from the outer end of the first upright side wall 52 into the sliding way 51. The springy hook 521 has a base 5212 integral with the first upright sidewall 52 and suspended in the sliding way 51, and a tip 5211 curving from the base 5212 toward the second upright sidewall 53 and defining with the second upright sidewall 53 a narrow gap 9 (see FIG. 9). When coupling the slides 6 and 7 to the zipper tapes 1, the slides 6 and 7 are respectively moved into the gap 9 to force the a tip 5211 backwards (see the dotted line in FIG. 9), and therefore the slides 6 and 7 can easily be moved through the gap 9 and coupled to the zipper tapes 1. When the slides 6 and 7 passed through the gap 9, the spring hook 521 immediately return to its former shape, prohibiting backward movement of the slides 6 and 7 into the inside of the gap 9 (see FIG. 8). When the user pulled the lower slide 7 downwards to the lower limit position, the base 5212 of the spring hook 521 stops one sidewall 71 of the lower slide 7 from downward movement, and therefore the lower slide 7 is held in the lower limit position (see FIG. 8).

Figure 5:
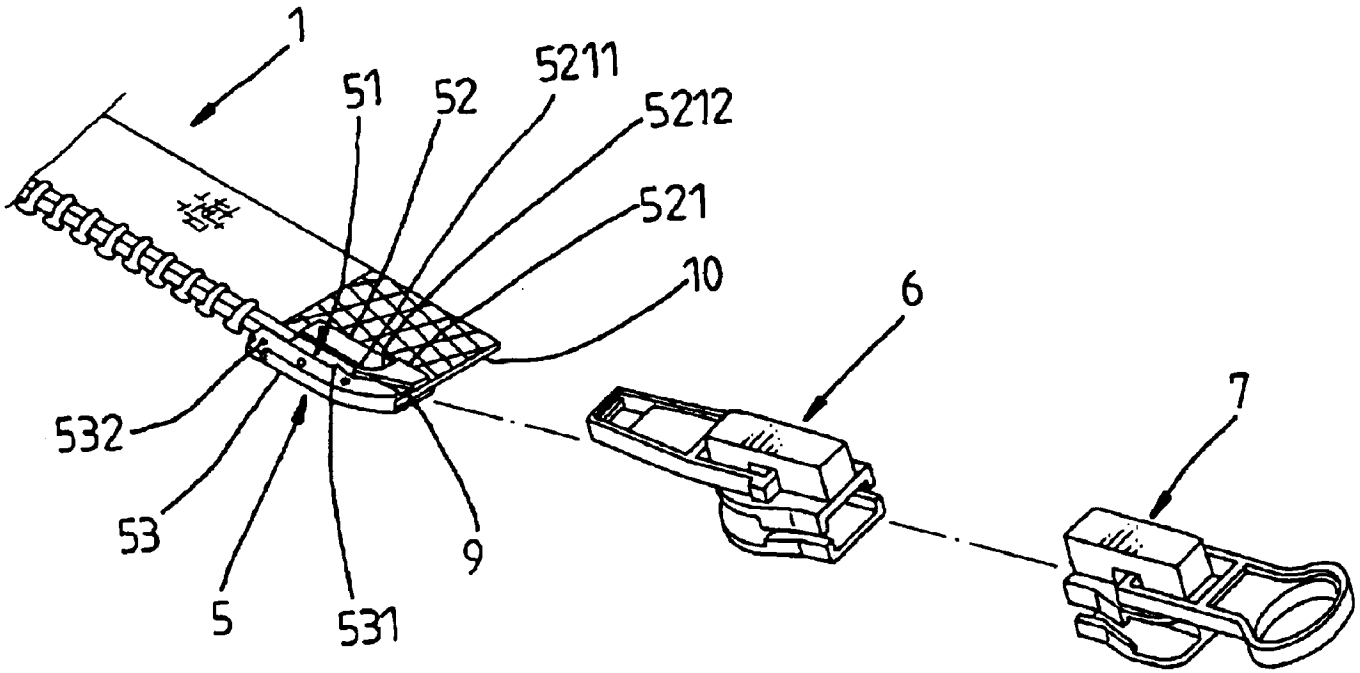
FIG. 5 is an exploded view of a part of the two way open-end zipper according to the first embodiment of the present invention.
Figure 6:
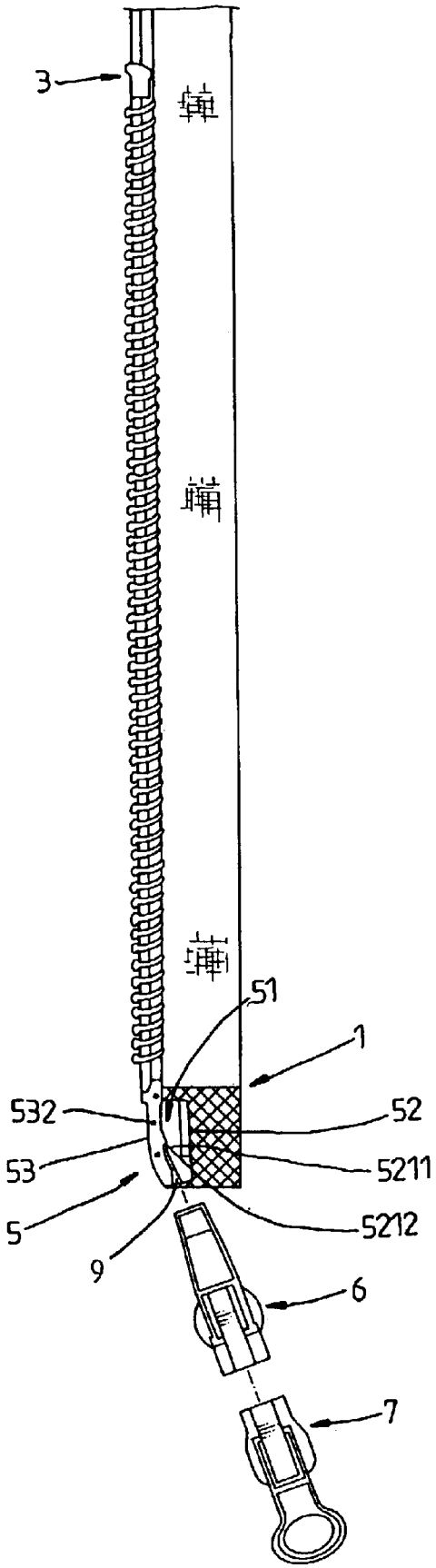
FIG. 6 is another exploded view of a part of the two way open-end zipper according to the first embodiment of the present invention.
Figure 7:
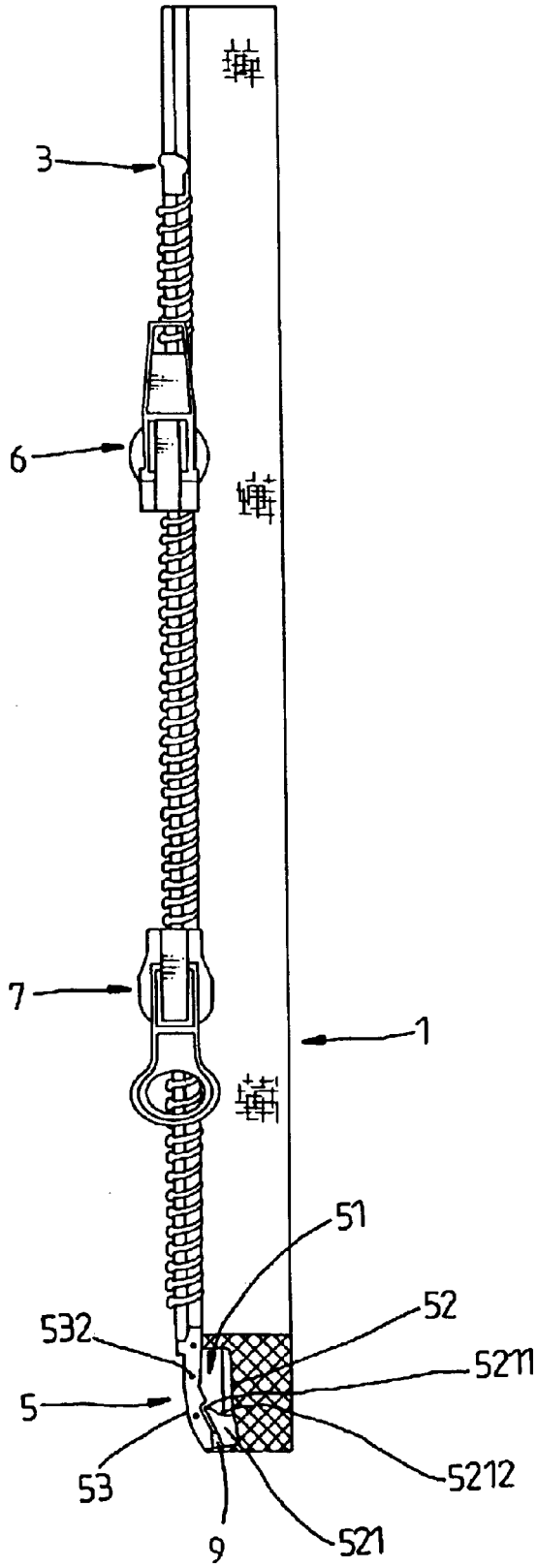
FIG. 7 is an assembly view of FIG. 6.
Figure 8:
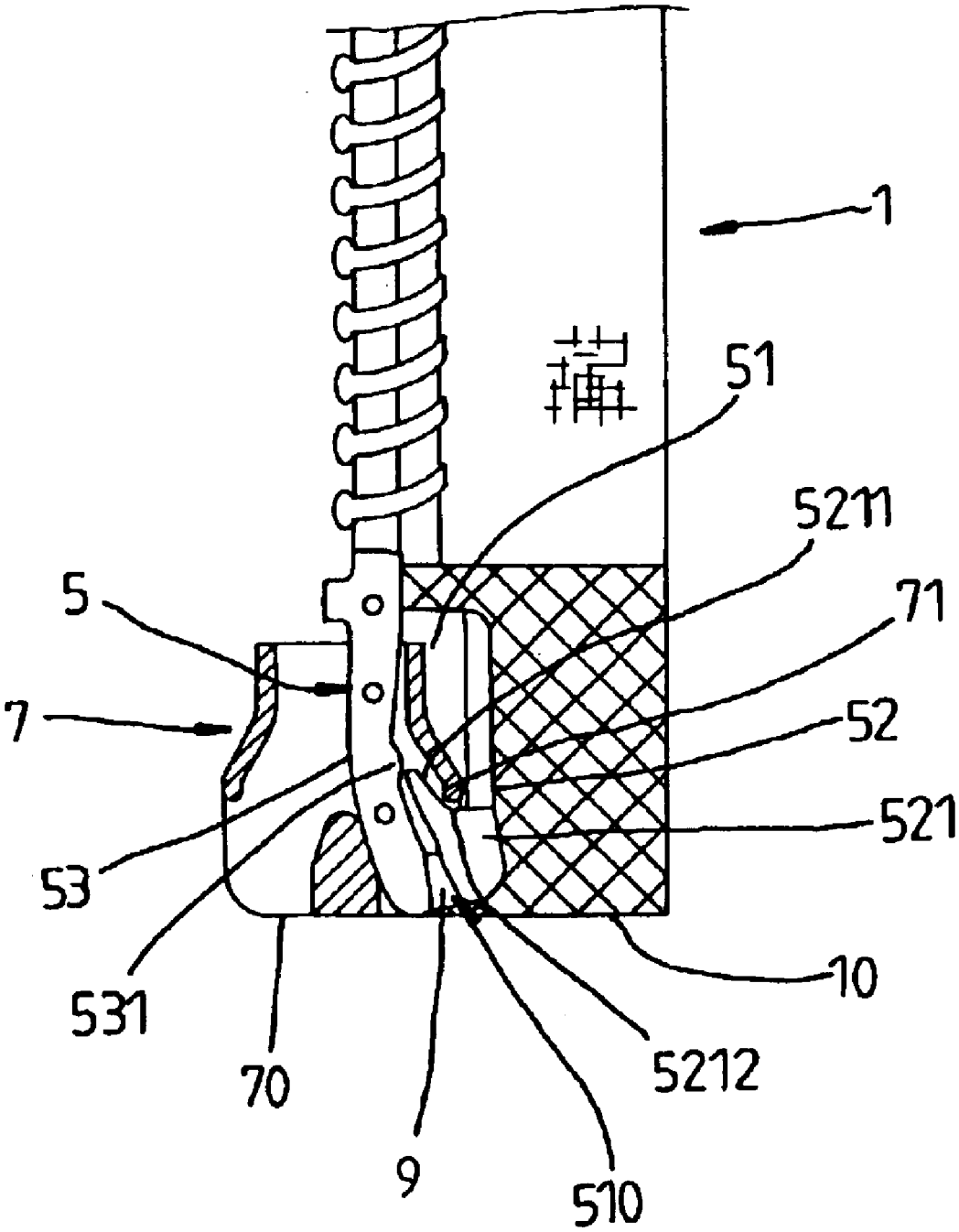
FIG. 8 is an enlarged view, partially in section of the two way open-end zipper according to the first embodiment of the present invention, showing the lower slide stopped in the lower limit position.

As indicated above, the slides 6 and 7 can be moved through the gap 9 in proper order and respectively coupled to the zipper tapes 1 (see FIGS. 5~7). According to the design, the top stops 2 and 3 and the pin 4 and 5 can be injection-molded from plastics on the zipper tapes 1 at a time. Because this one single step injection-molding procedure is simple, the manufacturing cost of the two way open-end zipper can greatly be reduced. In case the slides 6 and 7 are damaged, they can be conveniently disconnected from the zipper tapes 1 for replacement. By means of forcing the tip 5211 backwards to expand the gap 9, the slides 6 and 7 can easily be moved backwards through the gap 9 and disconnected from the zipper tapes 1. Because the top stops 2 and 3 and the pin 4 and 5 are molded from plastics, they do not contain lead or nickel that may cause an environmental pollution problem when the zipper thrown away after use.

Figure 9:
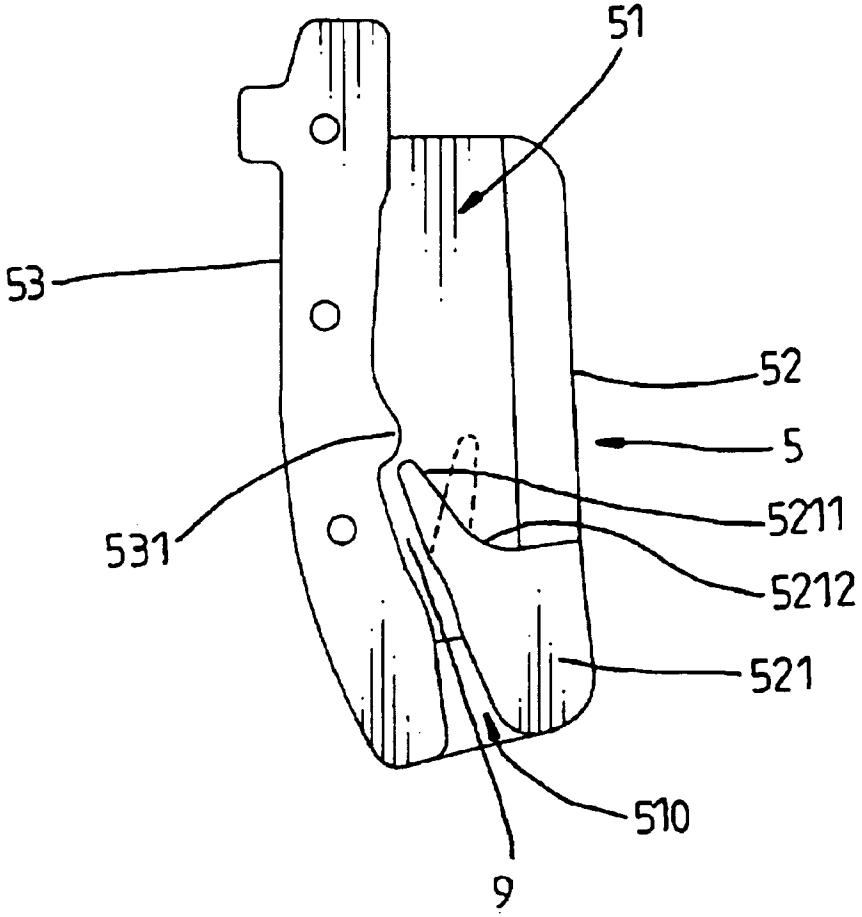
FIG. 9 is an enlarged view in plain of the fixed pin of the two way open-end zipper according to the first embodiment of the present invention.

The fixed pin 5 further comprises a projection 531 protruded from one side adjacent to the tip 5211 of the spring hook 521 and adapted to stop the slides 6 and 7 from passing over the tip 5211 into the sliding way 51 when the user pulled the slides 6 and 7 downwards to the lower limit position (see FIG. 9). The sliding way 51 of the fixed pin 5 is formed of a thin flat strip 510 connected between the upright sidewalls 52 and 53 (see FIG. 9). The fixed pin 5 has a plurality of through holes 532 in the second upright sidewall 53 that release stress produced upon molding of the fixed pin 5 on the corresponding zipper tape 1 (see FIGS. 3~9). The upright sidewalls 52 and 53 each have a part extended over and fixedly secured to the bottom face of the corresponding zipper tape 1 (see FIG. 4). Therefore, the connection between the fixed pin 5 and the corresponding zipper tape 1 is reinforced. According to this embodiment, the tip 5211 of the spring hook 521 is pointed. However, the tip 5211 can be made having a rounded, rhombic, or oval profile.

FIGS. 10~16 show a two way open-end zipper constructed according to the second embodiment of the present invention. According to this embodiment, the fixed pin 5 comprises a first upright sidewall 52, a second upright sidewall 53, a thin flat strip 510 connected between the upright sidewalls 52 and 53 and defining a longitudinal sliding way 51 between the upright sidewalls 52 and 53, and a spring hook 521 projected from the outer end of the first upright side wall 52 into the sliding way 51. The springy hook 521 has a base 5212 integral with the first upright sidewall 52 and suspended in the sliding way 51, and a tip 5211 curving from the base 5212 toward the second upright sidewall 53 and defining with the second upright sidewall 53 a narrow gap 9. The tip 5211 has an obliquely backwardly extended protruding face 5213. When coupling the slides 6 and 7 to the zipper tapes 1, the slides 6 and 7 are respectively moved into the gap 9 to force the a tip 5211 backwards, and therefore the slides 6 and 7 can easily be moved through the gap 9 and coupled to the zipper tapes 1. When the slides 6 and 7 passed through the gap 9, the spring hook 521 immediately return to its former shape, prohibiting backward movement of the slides 6 and 7 into the inside of the gap 9. When the user pulled the lower slide 7 downwards to the lower limit position, the base 5212 of the spring hook 521 stops one sidewall 71 of the lower slide 7 from downward movement, and therefore the lower slide 7 is held in the lower limit position (see FIGS. 15 and 16).

Figure 10:
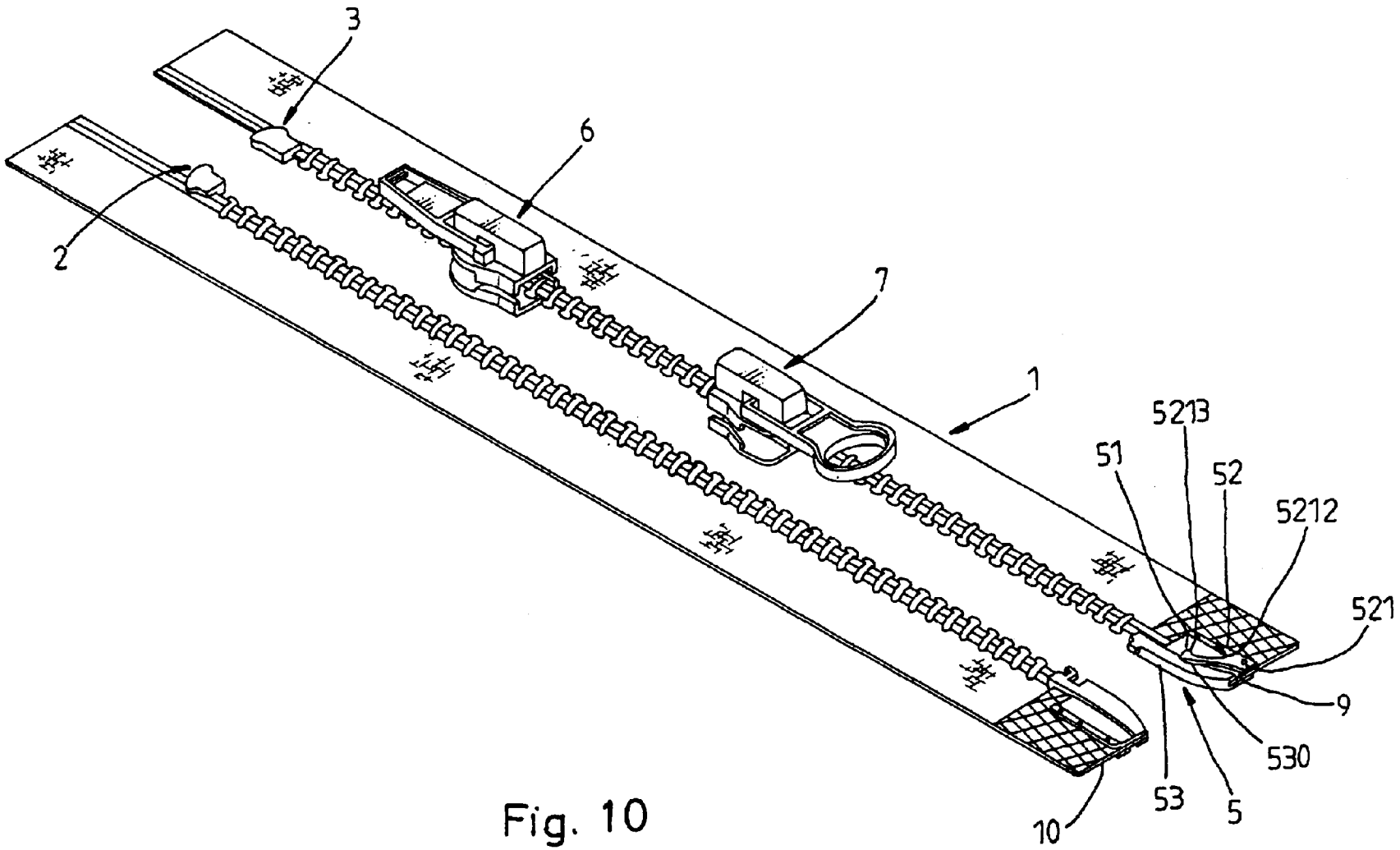
FIG. 10 is an exploded view of a two way open-end zipper according to the second embodiment of the present invention.
Figure 11:
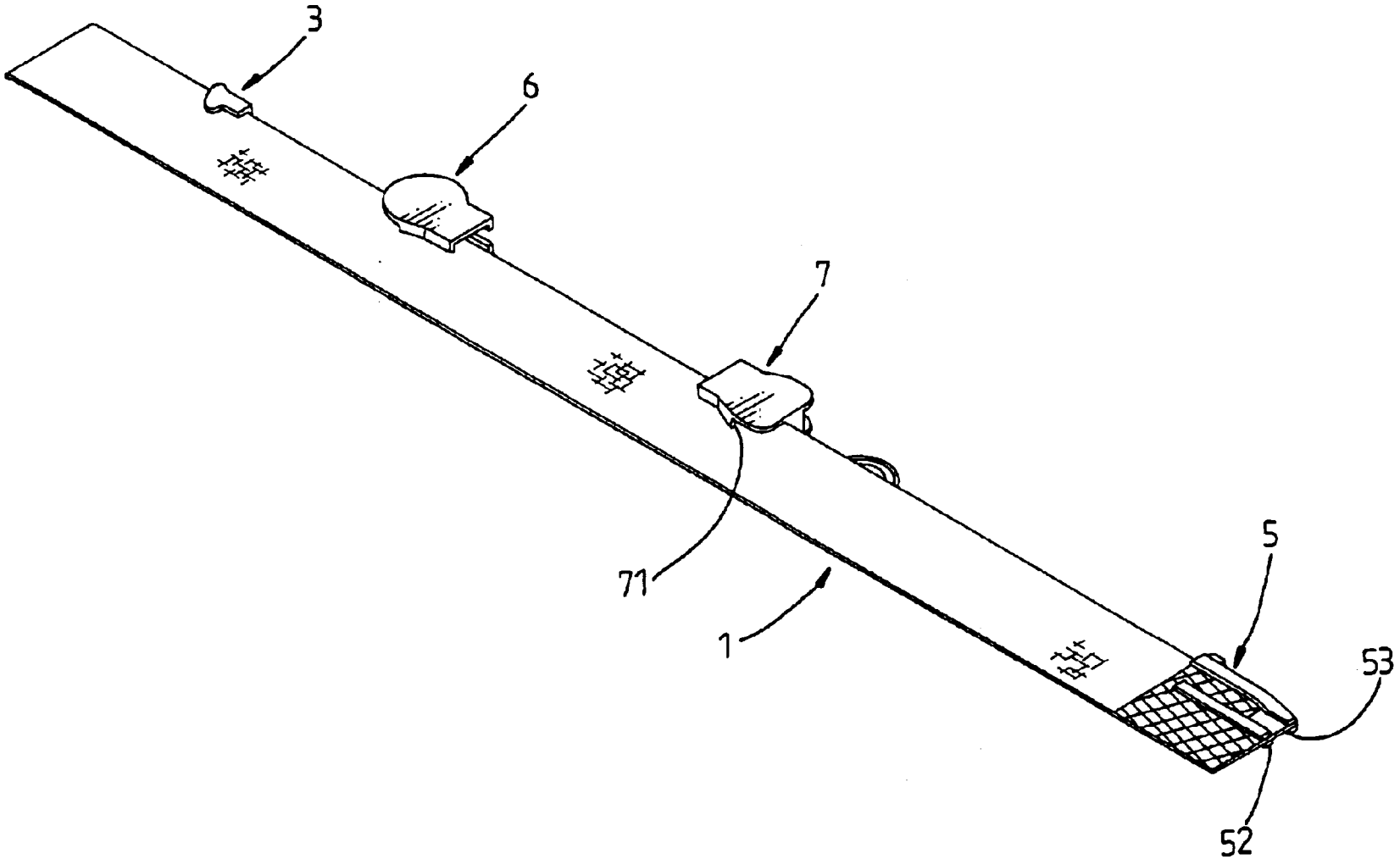
FIG. 11 is a back side view of a part of the two way open-end zipper according to the second embodiment of the present invention, showing the first and second upright sidewalls of the fixed pin fastened to the bottom face of the corresponding zipper tape.
Figure 12:
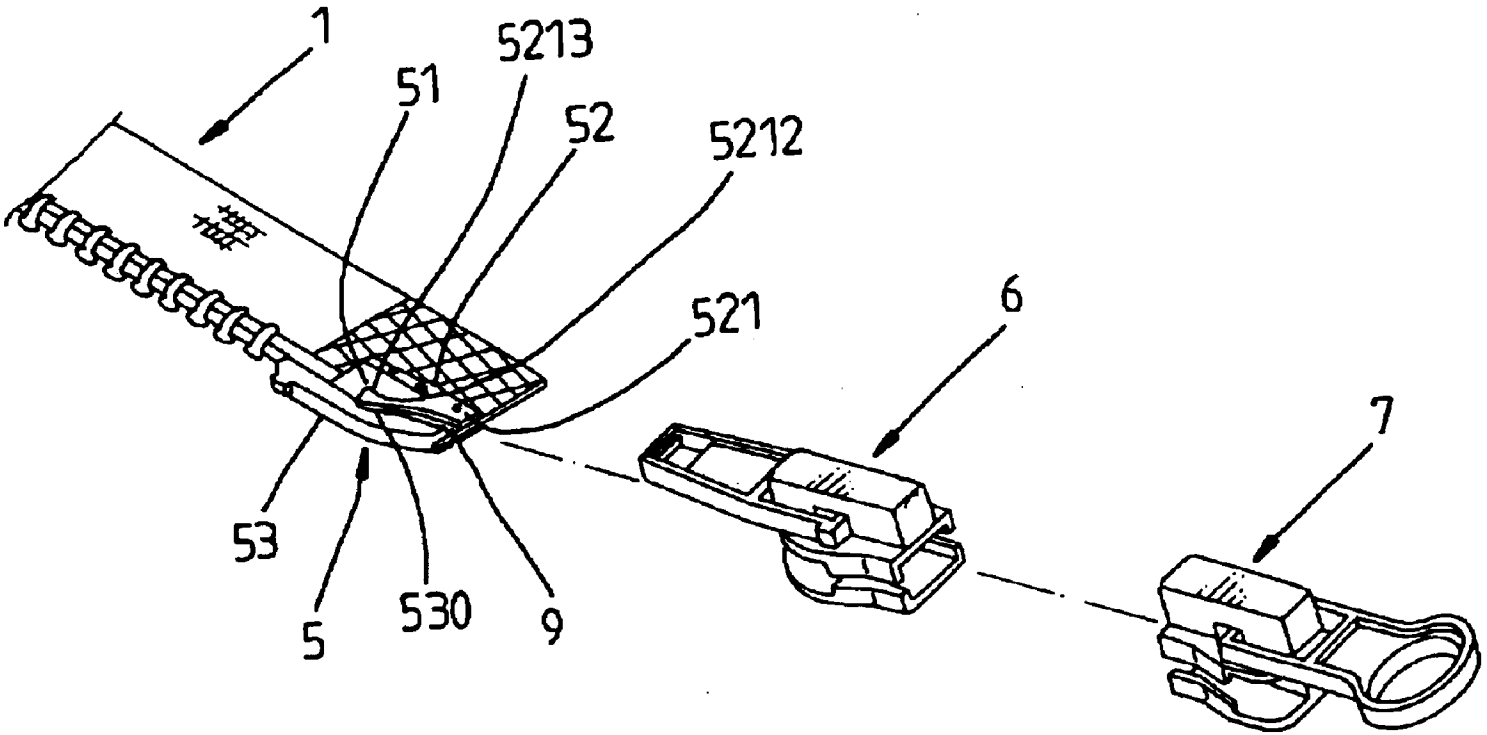
FIG. 12 is an exploded view of a part of the two way open-end zipper according to the second embodiment of the present invention.
Figure 13:
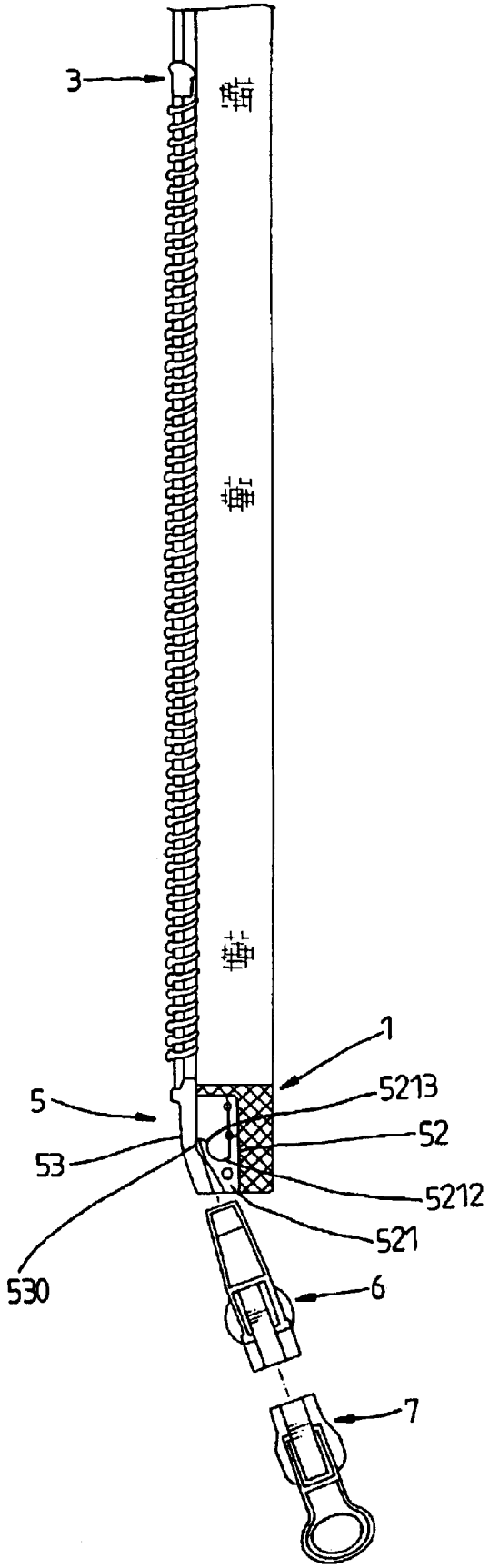
FIG. 13 is another exploded view of a part of the two way open-end zipper according to the second embodiment of the present invention.
Figure 14:
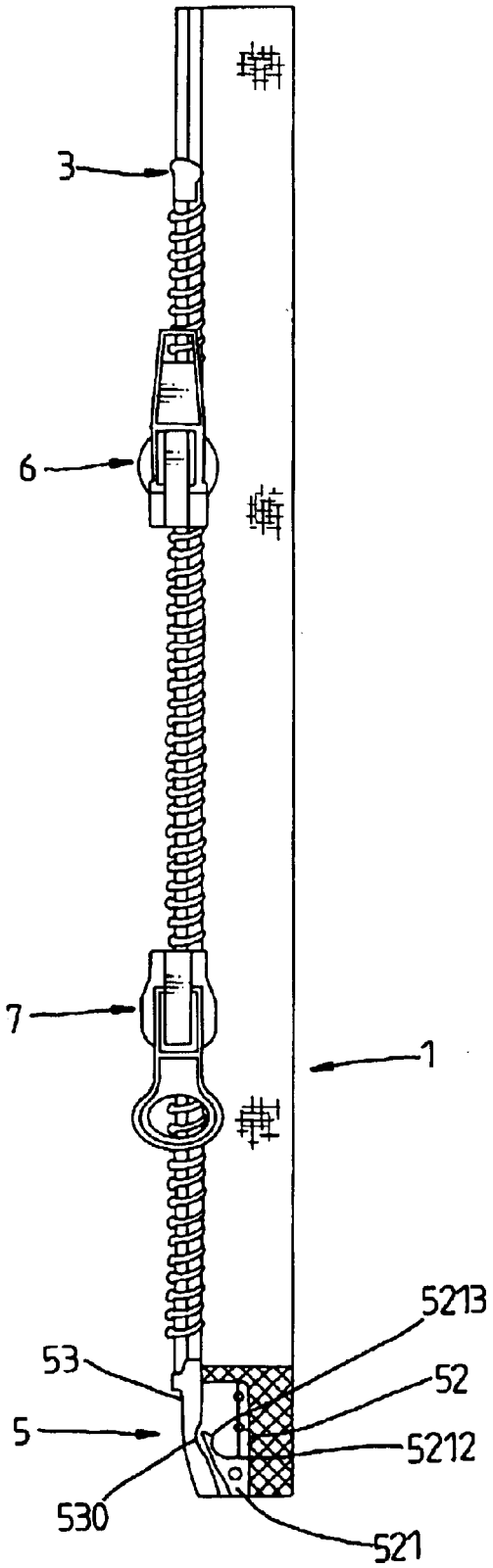
FIG. 14 is an assembly view of FIG. 13.
Figure 15:
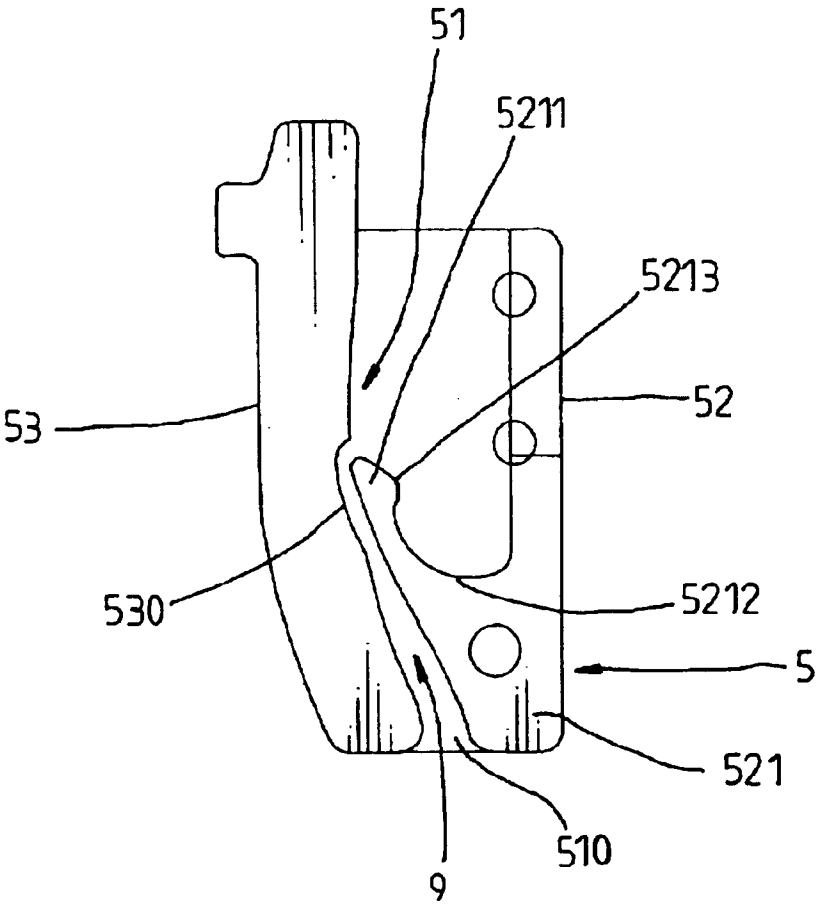
FIG. 15 is an enlarged view in plain of the fixed pin of the two way open-end zipper according to the second embodiment of the present invention.
Figure 16:
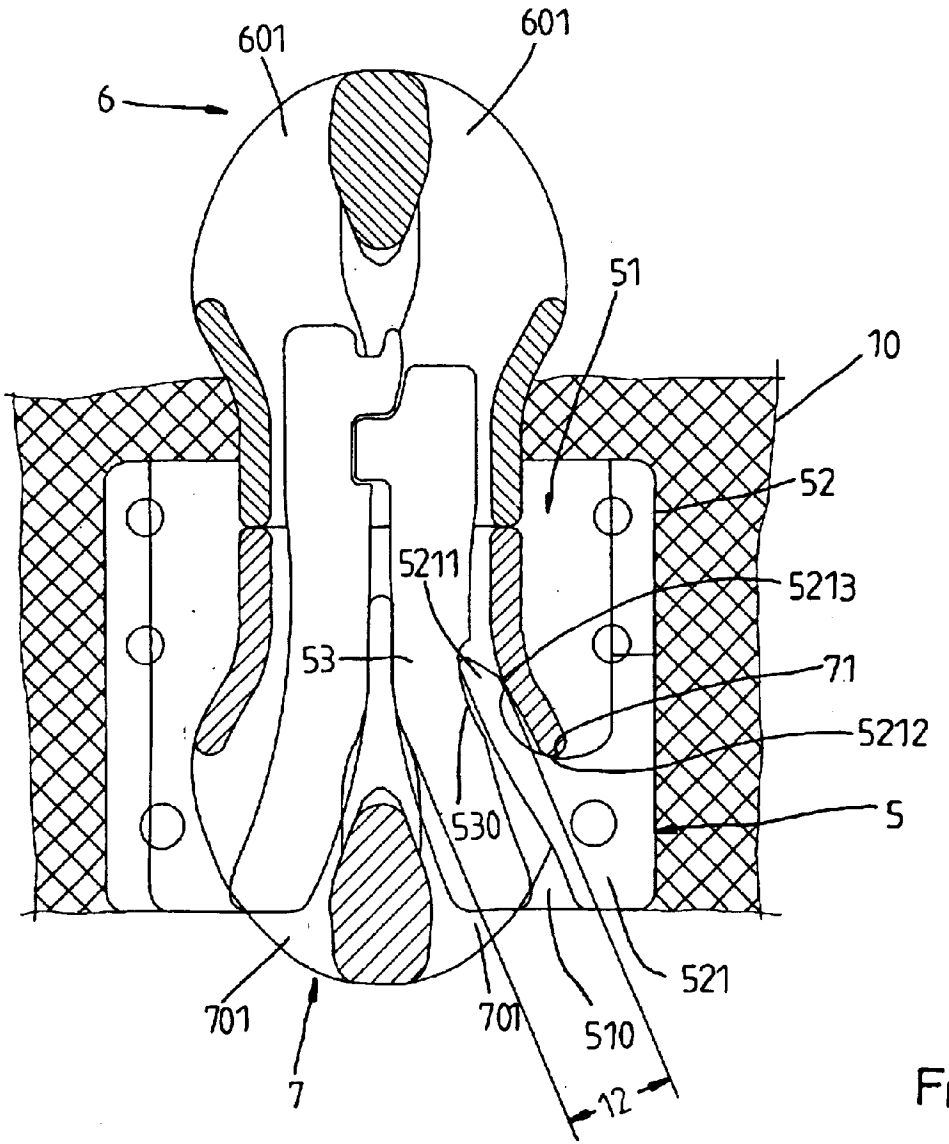
FIG. 16 is a top plain view in an enlarged scale of a part of the two way open-end zipper according to the second embodiment of the present invention, showing the slides moved through the fixed pin.

As indicated above, the slides 6 and 7 can be moved through the gap 9 in proper order and respectively coupled to the zipper tapes 1 (see FIG. 10). According to the design, the top stops 2 and 3 and the pin 4 and 5 can be injection-molded from plastics on the zipper tapes 1 at a time. Because this one single step injection-molding procedure is simple, the manufacturing cost of the two way open-end zipper can greatly be reduced. In case the slides 6 and 7 are damaged, they can be conveniently disconnected from the zipper tapes 1 for replacement. By means of forcing the tip 5211 backwards to expand the gap 9, the slides 6 and 7 can easily be moved backwards through the gap 9 and disconnected from the zipper tapes 1. Because the top stops 2 and 3 and the pin 4 and 5 are molded from plastics, they do not contain lead or nickel that may cause an environmental pollution problem when the zipper thrown away after use. Further, the obliquely backwardly extended protruding face 5213 of the tip 5211 of the spring hook 521 effectively stops the slide 7 in place when the slide 7 moved to the lower limit position to close the zipper tapes 1.

The second upright sidewall 53 of the fixed pin 5 has a recessed portion 530 adapted to accommodate the tip 5211 of the spring hook 521. The combined width 12 of the maximum width of the tip 5211 and the width of the second upright sidewall 53 around the recessed portion 530 is slightly smaller than the passageway 601 or 701 of the slide 6 or 7. Therefore, the slides 6 and 7 can easily and smoothly be moved over the fixed pin 5 and coupled to the zipper tapes 1, which may be made for a small zipper, for example, No. 3 or No. 4.

As indicated above, the invention achieves the following advantages:

1. Because top stops 2 and 3 and the pins 4 and 5 are injection-molded from plastics on the zipper tapes 1 at a time, the fabrication procedure of the two way open-end zipper is simple and, the manufacturing cost of the two way open-end zipper is low.
2. Because the slides 6 and 7 are detachably coupled to the zipper tapes 1, they can be removed from the zipper tapes 1 for a replacement when damaged.
3. When the lower slide 7 moved to the lower limit position, the bottom side 70 of the lower slide 7 is maintained in front of the bottom side 10 of the corresponding zipper tape 1. Because the lower slide 7 does to protrude over the bottom side 10 of the corresponding zipper tape 1, the lower slide 7 does not obstruct the sense of beauty of the clothe in which the two way open-end zipper is installed when the lower slide 7 moved to the lower limit position.
4. The obliquely backwardly extended protruding face 5213 of the tip 5211 of the spring hook 521 effectively stops the slide 7 in place when the slide 7 moved to the lower limit position to close the zipper tapes 1. Because the combined width W of the maximum width of the tip 5211 and the width of the second upright sidewall 53 around the recessed portion 530 is slightly smaller than the passageway 601 or 701 of the slide 6 or 7, the slides 6 and 7 can easily and smoothly be moved over the fixed pin 5 and coupled to the zipper tapes 1, which may be made for a small zipper, for example, No. 3 or No. 4.

A prototype of two way opened zipper has been constructed with the features of FIGS. 3~16. The two way open-end zipper functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A two way open-end zipper comprising two zipper tapes, a left top stop and a right top stop respectively fixedly molded from plastics on said zipper tapes near a top side, a plug pin and a fixed pin respectively fixedly molded from plastics on said zipper tapes at a bottom side, and an upper slide and a lower slide respectively coupled to said zipper tapes and adapted to close/open said zipper tapes, said plug pin and said fixed pin each defining a longitudinally extended sliding way, wherein said fixed pin comprises a first upright sidewall and a second upright sidewall longitudinally extended along two sides of the longitudinally extended sliding way of said fixed pin, and a springy hook projected from an outer end of said first upright side wall into the longitudinally extended sliding way of said fixed pin, said springy hook having a base integral with said first upright sidewall and suspended in the longitudinally extended sliding way of said fixed pin and a tip curving from said base toward said second upright sidewall and defining with said second upright sidewall a narrow gap, wherein said fixed pin further comprises a projection protruded from said second upright sidewall and facing the tip of said spring hook.

2. The two way open-end zipper as claimed in claim 1, wherein said first upright sidewall and said second upright sidewall of said fixed pin each have a part extended over and fixedly fastened to a bottom face of the corresponding zipper tape.

3. The two way open-end zipper as claimed in claim 1, wherein said tip of said spring hook is pointed.

4. The two way open-end zipper as claimed in claim 1, wherein said tip of said spring hook is rounded.

5. The two way open-end zipper as claimed in claim 1, wherein said tip of said spring hook has a rhombic profile.

6. The two way open-end zipper as claimed in claim 1, wherein said tip of said spring hook has an oval profile.

7. A two way open-end zipper comprising two zipper tapes, a left top stop and a right top stop respectively fixedly molded from plastics on said zipper tapes near a top side, a plug pin and a fixed pin respectively fixedly molded from plastics on said zipper tapes at a bottom side, and an upper slide and a lower slide respectively coupled to said zipper tapes and adapted to close/open said zipper tapes, said plug pin and said fixed pin each defining a longitudinally extended sliding way, wherein said fixed pin comprises a first upright sidewall and a second upright sidewall longitudinally extended along two sides of the longitudinally extended sliding way of said fixed pin, and a springy hook projected from an outer end of said first upright side wall into the longitudinally extended sliding way of said fixed pin, said springy hook having a base integral with said first upright sidewall and suspended in the longitudinally extended sliding way of said fixed pin and a tip curving from said base toward said second upright sidewall and defining with said second upright sidewall a narrow gap, wherein said fixed pin comprises a thin flat strip connected between said first and second upright sidewalls and defining with said first and second upright sidewalls the longitudinally extended sliding way of said fixed pin.

8. The two way open-end zipper as claimed in claim 7, wherein said first upright sidewall and said second upright sidewall of said fixed pin each have a part extended over and fixedly fastened to a bottom face of the corresponding zipper tape.

9. The two way open-end zipper as claimed in claim 7, wherein said tip of said spring hook is pointed.

10. The two way open-end zipper as claimed in claim 7, wherein said tip of said spring hook is rounded.

11. The two way open-end zipper as claimed in claim 7, wherein said tip of said spring hook has a rhombic profile.

12. The two way open-end zipper as claimed in claim 7, wherein said tip of said spring hook has an oval profile.

13. A two way open-end zipper comprising two zipper tapes, a left top stop and a right top stop respectively fixedly molded from plastics on said zipper tapes near a top side, a plug pin and a fixed pin respectively fixedly molded from plastics on said zipper tapes at a bottom side, and an upper slide and a lower slide respectively coupled to said zipper tapes and adapted to close/open said zipper tapes, said plug pin and said fixed pin each defining a longitudinally extended sliding way, wherein said fixed pin comprises a first upright sidewall and a second upright sidewall longitudinally extended along two sides of the longitudinally extended sliding way of said fixed pin, and a springy hook projected from an outer end of said first upright side wall into the longitudinally extended sliding way of said fixed pin, said springy hook having a base integral with said first upright sidewall and suspended in the longitudinally extended sliding way of said fixed pin and a tip curving from said base toward said second upright sidewall, said tip having a first side, a protruding face obliquely backwardly extended from said first side toward said first upright sidewall, and a second side, which faces said second upright sidewall and defines with said second upright sidewall a narrow gap, wherein said fixed pin further comprises a recessed portion formed in one side of said second upright sidewall and adapted to accommodate the tip of said spring hook; the combined width of the maximum width of said tip of said spring hook plug the width of said second upright sidewall around said recessed portion is slightly smaller than the passageway each of said upper and lower slides through which interlocking teeth of said zipper tapes pass.

14. The two way open-end zipper as claimed in claim 13, wherein said first upright sidewall and said second upright sidewall of said fixed pin each have a part extended over and fixedly fastened to a bottom face of the corresponding zipper tape.

15. A two way open-end zipper comprising two zipper tapes, a left top stop and a right top stop respectively fixedly molded from plastics on said zipper tapes near a top side, a plug pin and a fixed pin respectively fixedly molded from plastics on said zipper tapes at a bottom side, and an upper slide and a lower slide respectively coupled to said zipper tapes and adapted to close/open said zipper tapes, said plug pin and said fixed pin each defining a longitudinally extended sliding way, wherein said fixed gin comprises a first upright sidewall and a second upright sidewall longitudinally extended along two sides of the longitudinally extended sliding way of said fixed pin, and a springy hook projected from an outer end of said first upright side wall into the longitudinally extended sliding way of said fixed pin, said springy hook having a base integral with said first upright sidewall and suspended in the longitudinally extended sliding way of said fixed pin and a tip curving from said base toward said second upright sidewall, said tip having a first side, a protruding face obliquely backwardly extended from said first side toward said first upright sidewall, and a second side, which faces said second upright sidewall and defines with said second upright sidewall a narrow gap, wherein said fixed pin comprises a thin flat strip connected between said first and second upright sidewalls and defining with said first and second upright sidewalls the longitudinally extended sliding way of said fixed pin.

16. The two way open-end zipper as claimed in claim 15, wherein said first upright sidewall and said second upright sidewall of said fixed pin each have a part extended over and fixedly fastened to a bottom face of the corresponding zipper tape.

* * * * *